US009807532B2

(12) United States Patent
Sooriakumar et al.

(10) Patent No.: US 9,807,532 B2
(45) Date of Patent: Oct. 31, 2017

(54) ACOUSTIC APPARATUS, SYSTEM AND METHOD OF FABRICATION

(71) Applicants: Kathirgamasundaram Sooriakumar, Rochester, NY (US); Anu Austin, Lengkong Tiga (SG); Ian Rose Bihag, Cebu (PH)

(72) Inventors: Kathirgamasundaram Sooriakumar, Rochester, NY (US); Anu Austin, Lengkong Tiga (SG); Ian Rose Bihag, Cebu (PH)

( * ) Notice: Subject to any disclaimer, the term of this patent is extended or adjusted under 35 U.S.C. 154(b) by 0 days.

(21) Appl. No.: 15/162,142

(22) Filed: May 23, 2016

(65) Prior Publication Data

US 2016/0345105 A1 Nov. 24, 2016

Related U.S. Application Data

(60) Provisional application No. 62/165,408, filed on May 22, 2015.

(51) Int. Cl.

| | |
|---|---|
| ***H04R 25/00*** | (2006.01) |
| ***H04R 31/00*** | (2006.01) |
| ***H04R 17/00*** | (2006.01) |
| *H04R 19/00* | (2006.01) |

(52) U.S. Cl.

CPC ..... *H04R 31/003* (2013.01); *H04R 17/00* (2013.01); *H04R 19/005* (2013.01); *H04R 2201/003* (2013.01)

(58) Field of Classification Search

CPC ..... H04R 31/003; H04R 17/00

See application file for complete search history.

(56) References Cited

U.S. PATENT DOCUMENTS

| | | | | |
|---|---|---|---|---|
| 6,741,710 | B1 | 5/2004 | Takeshima et al. | |
| 8,081,782 | B2 | 12/2011 | Klinghult | |
| 8,520,868 | B2 * | 8/2013 | Jeong | H04R 17/00 381/190 |
| 9,029,963 | B2 | 5/2015 | Sparks et al. | |
| 9,170,164 | B2 * | 10/2015 | Naegele-Preissmann | G01L 1/148 |
| 2008/0018714 | A1 * | 1/2008 | Domoto | B41J 2/14233 347/70 |
| 2013/0301856 | A1 * | 11/2013 | Kim | H04R 7/26 381/190 |
| 2016/0037263 | A1 * | 2/2016 | Pal | H04R 19/04 381/113 |

FOREIGN PATENT DOCUMENTS

| | | | |
|---|---|---|---|
| JP | 2010119032 | A | 5/2010 |
| SG | 148069 | A1 | 12/2008 |

* cited by examiner

*Primary Examiner* — Simon King

(74) *Attorney, Agent, or Firm* — Oblon, McClelland, Maier & Neustadt, L.L.P.

(57) ABSTRACT

An acoustic apparatus includes an anchored diaphragm that is actuated by mechanical energy and a transduction material that is disposed in the anchored diaphragm that generates the mechanical energy that actuates the anchored diaphragm. The acoustic apparatus further includes an extendable diaphragm that is actuated when the anchored diaphragm is actuated and a plurality of damping holes that are disposed about the extendable diaphragm and that allow the extendable diaphragm to actuate in a vertical direction.

11 Claims, 17 Drawing Sheets

Figure 10a. Piezo electric actuation

Figure 10b. Electro static actuation

2400

ACOUSTIC APPARATUS, SYSTEM AND METHOD OF FABRICATION

CROSS-REFERENCE TO RELATED APPLICATION

This application claims the benefit of U.S. Provisional Application No. 62/165,408, filed May 22, 2015.

BACKGROUND

The "background" description provided herein is for the purpose of generally presenting the context of the disclosure. Work of the presently named inventor, to the extent it is described in this background section, as well as aspects of the description which may not otherwise qualify as prior art at the time of filing, are neither expressly nor impliedly admitted as prior art against the present disclosure.

Mobile communication has become a significant contributor in today's economic growth largely due to the phenomenal success of mobile smart phones. At least part of this success are the technology advances in semiconductor manufacturing processes specifically targeted towards micro electro mechanical systems MEMS). These developments acted as catalysts to miniaturize components while delivering enhanced performance, resulting in smaller and smarter phones. As such, consumers rapidly adopted phones with expanded feature sets such as health monitoring, music, gaming etc. embedded within the smart phone. This downward spiraling phenomenon has caused the smart phone users to expect the best acoustic experience with highest quality and reliability from the smallest of devices and at low cost.

The acoustic experience while using the smart phone depends upon the performance of its acoustic components, such as the microphone, receiver and speaker. There is a need to improve the performance of these devices while maintaining high quality, low cost, and small device size. All these characteristics are the hall mark of the MEMS semiconductor technology.

The semiconductor microphone ("silicon microphone") has displaced the electret condenser microphone and established itself as the top candidate of choice by smart phone manufacturers due to high performing characteristics with surface mount packaging flexibility at semiconductor level reliability. Unfortunately, such a solution does not exist for speakers and receivers. For these components, smart phones still utilize large devices that restrict design flexibility and that do not offer surface-mount options. These larger devices also reduce manufacturing efficiency and raise manufacturing costs.

SUMMARY

In an exemplary aspect, an acoustic apparatus includes an anchored diaphragm that is actuated by mechanical energy and a transduction material that is disposed in the anchored diaphragm that generates the mechanical energy that actuates the anchored diaphragm. The acoustic apparatus further includes an extendable diaphragm that is actuated when the anchored diaphragm is actuated and a plurality of damping holes that are disposed about the extendable diaphragm and that allow the extendable diaphragm to actuate in a vertical direction.

The foregoing general description of exemplary implementations and the following detailed description thereof are merely exemplary aspects of the teachings of this disclosure, and are not restrictive.

BRIEF DESCRIPTION OF THE DRAWINGS

A more complete appreciation of this disclosure and many of the attendant advantages thereof will be readily obtained as the same becomes better understood by reference to the following detailed description when considered in connection with the accompanying drawings, wherein.

DETAILED DESCRIPTION

Figure 1:
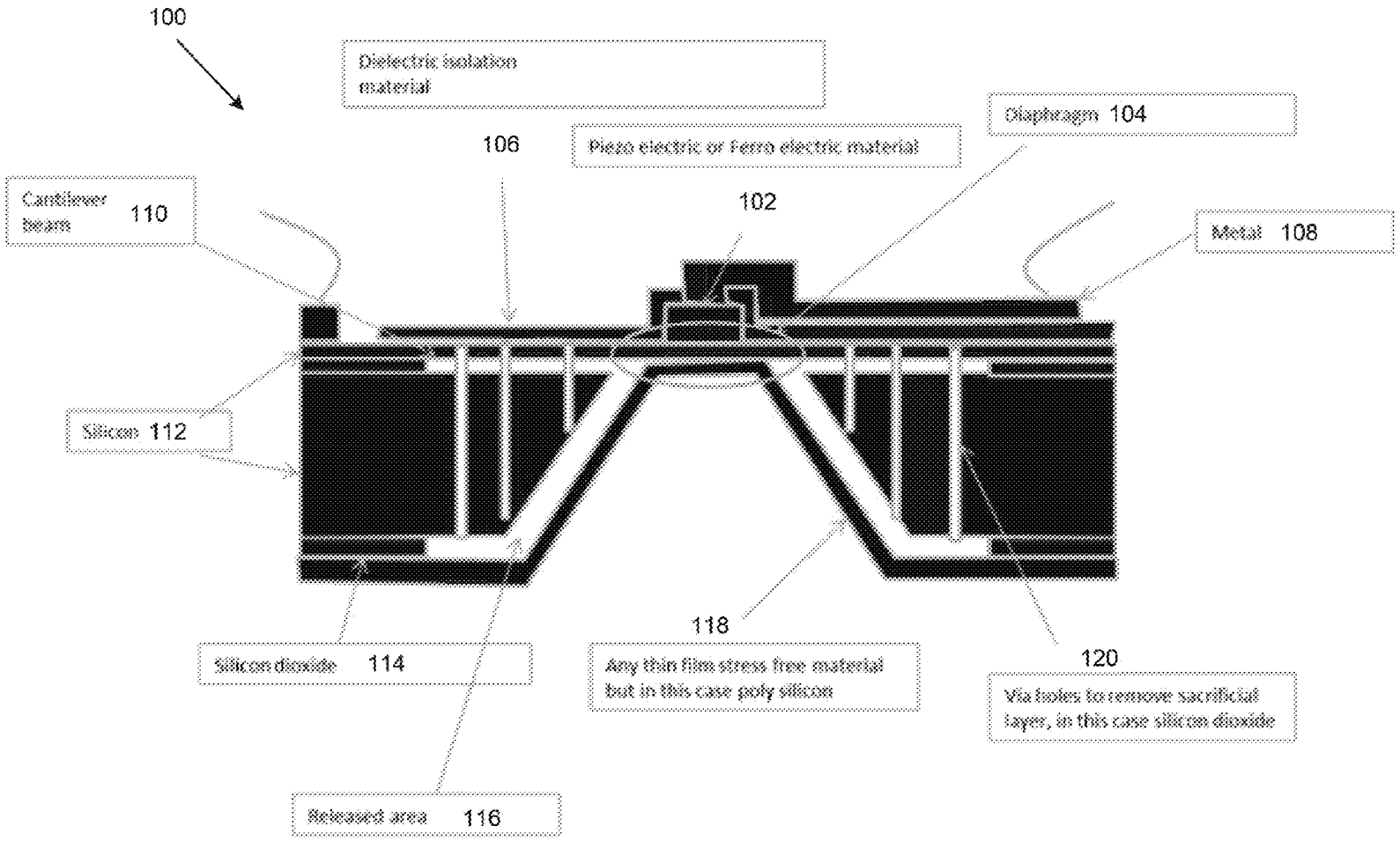
FIG. 1 is a cross section of an acoustic apparatus, according to certain exemplary aspects.

In the drawings, like reference numerals designate identical or corresponding parts throughout the several views. Further, as used herein, the words "a," "an" and the like generally carry a meaning of "one or more," unless stated otherwise.

FIG. 1 is a cross section of an acoustic apparatus 100, according to certain exemplary aspects. The cross section of an acoustic apparatus 100 shows the construction of the acoustic apparatus 100. The cross section of the acoustic apparatus 100 includes electric material 102, which may deposited in an anchored diaphragm 104. The electric material can include Piezo electric material, Ferro electric material, and the like. The Piezo electric material, Ferro electric material, and the like 102, can receive alternating current or voltage, transform the electrical energy into mechanical energy, and cause the anchored diaphragm 104 to vibrate due to continuous phase shifts in polarization as a result of the alternating voltage or current. As such, the vibration actuates the anchored diaphragm 104. The anchored diaphragm 104 can push on an extendable diaphragm, causing the extendable diaphragm 118 to actuate. For example, the extendable diaphragm 118 can be actuated by the movement of the anchored diaphragm 104 to oscillate and release sound waves. The extendable diaphragm 118 can include any thin film stress free material such as poly silicon. As would be known by one of ordinary skill in the art, the extendable diaphragm 118 can include any other suitable material or thin film. The acoustic apparatus can also be formed into shapes such as a square, a rectangle, or any other shape without departing from the scope of the present disclosure.

In certain aspects, a metal contact 108 is deposited partially or fully over the Piezo electric/Ferro electric material 102. The extendable diaphragm can be fixed to a cantilever beam 110 for flexibility, where the cantilever beam is further in contact with silicon 112 portions of the acoustic apparatus. The anchored diaphragm 104 and the extendable diaphragm can be separated by a released area 116 which may act as a buffer between the two diaphragms. The released area 116 can be in connection with the cantilever beam 110 via a plurality of damping holes 120. The plurality of damping holes 120 can allow the extendable diaphragm to freely actuate in a desired direction. The plurality of damping holes 120 can further be utilized to remove a sacrificial layer such as silicon dioxide 114 through the released area 116 between the anchored diaphragm 104 and the extendable diaphragm.

Figure 2:
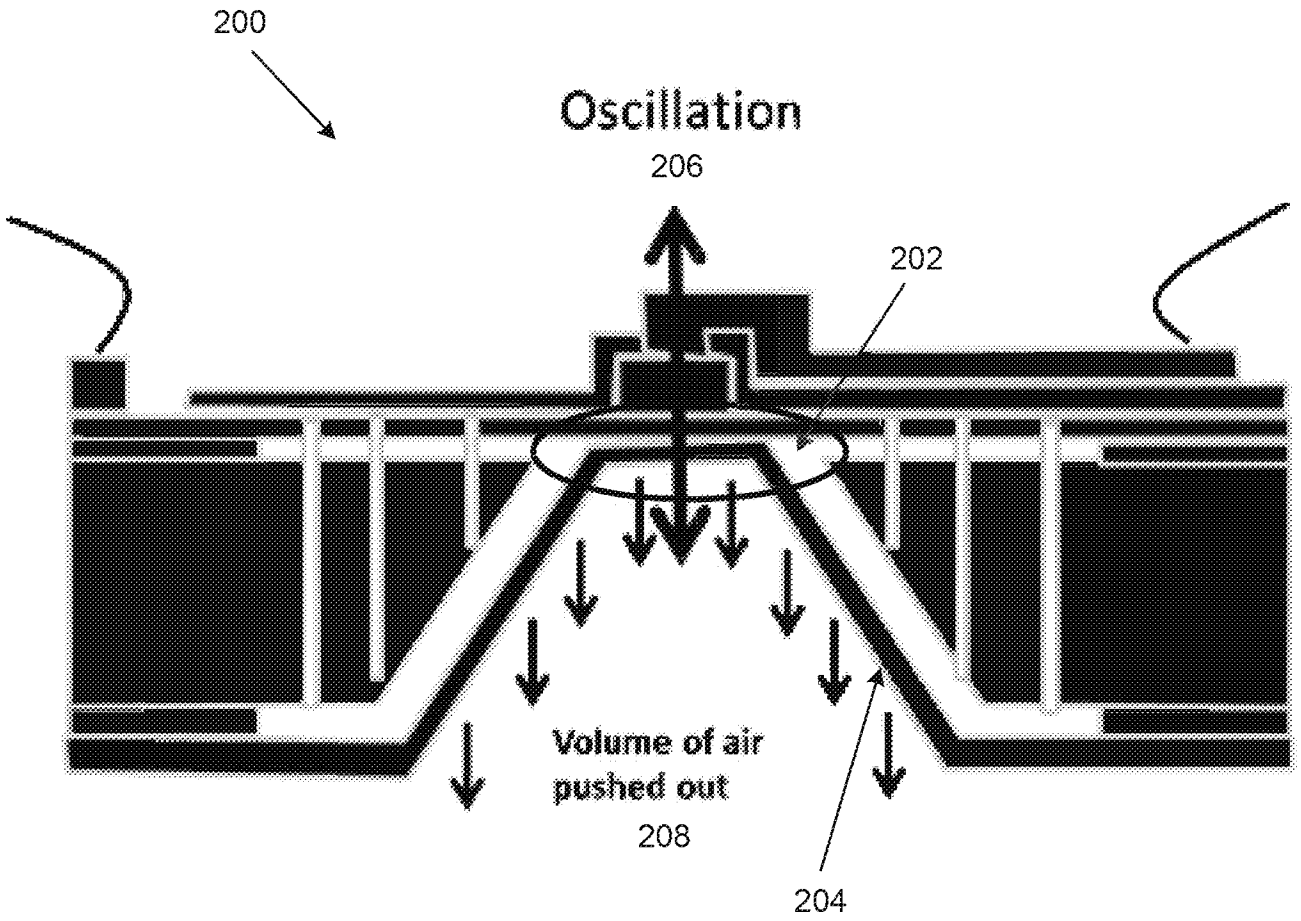
FIG. 2 is a cross section performance of an acoustic apparatus, according to certain exemplary aspects.
Figure 3:
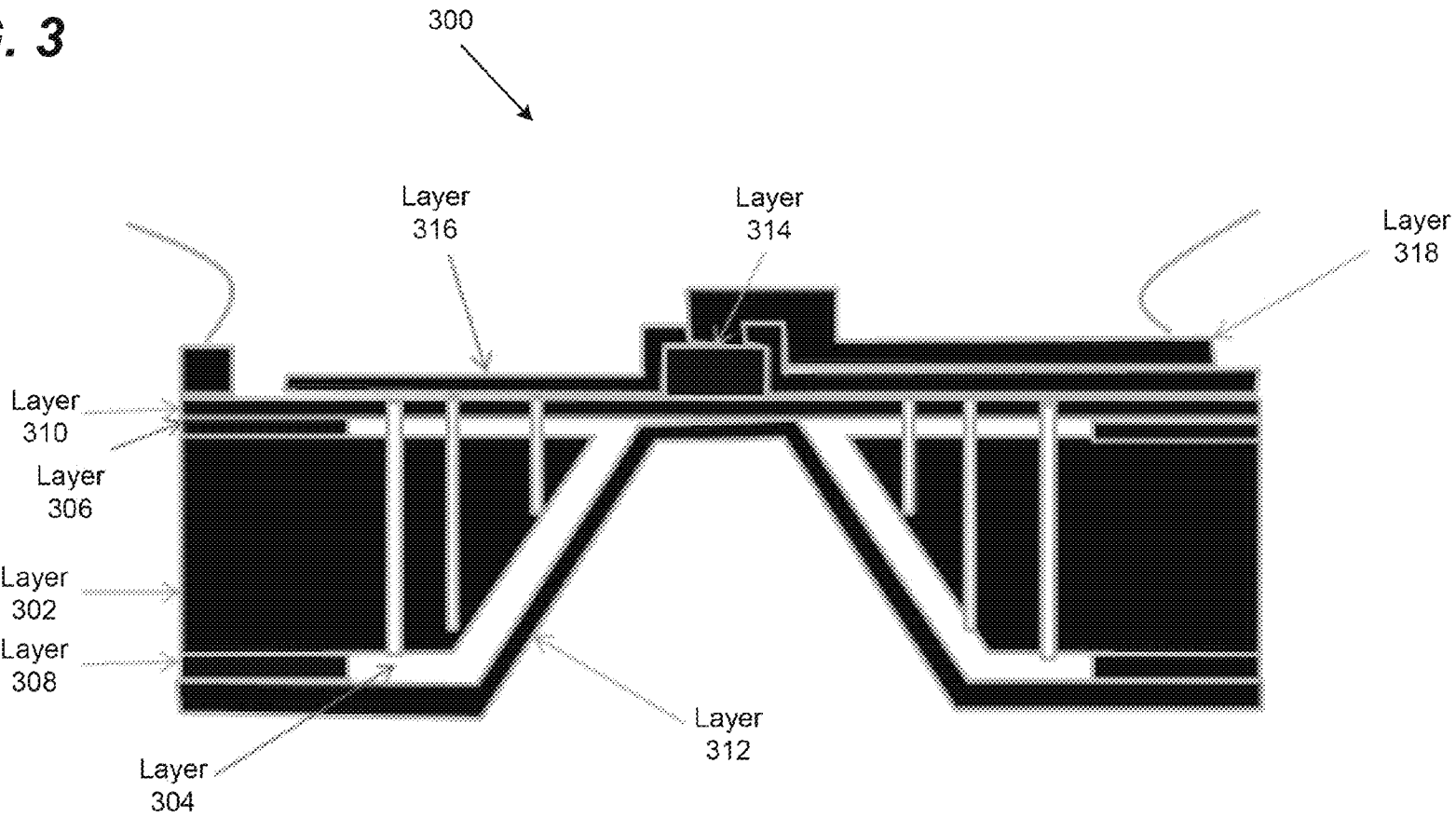
FIG. 3 is a layered cross section of an acoustic apparatus, according to certain exemplary aspects.

FIG. 2 is a cross section performance of an acoustic apparatus 200, according to certain exemplary aspects. The cross section performance of an acoustic apparatus 200 illustrates the actuation of an anchored diaphragm 202 via mechanical energy and the actuation of an extendable diaphragm 204 via the actuated anchored diaphragm 202. In this instance, the oscillation 206 of the anchored diaphragm 202 causes air to be pushed out 208 of the extendable diaphragm 204. In certain aspects, the quantity of oscillation 206 is directly proportional to the quantity of air 208 released out of the acoustic apparatus 200, FIG. 3 is a layered cross section of an acoustic apparatus 300, according to certain exemplary aspects. The layered cross section of an acoustic apparatus 300 includes a layer 304 that is etched to form a folded portion of layer 312. In certain aspects, the folded portion can be utilized as a spring. The layer 304 is etched again to form a cone-shaped cavity. Layer 306 and layer 308 can be grown or deposited over layer 302. In certain aspects, layer 306 is an anchored diaphragm. Layer 310 can be bonded to layer 302 in which layer 306 is utilized as an adhesive for the bonding. Layer 312 is grown over layer 308 and layer 304 in layer 306. Damping holes can be etched in predetermined locations throughout layers 310, 306, 302, and 304. Layer 308 can be partially or fully removed over a predetermined area. Layer 312 can be freed over the predetermined area in which layer 308 has been removed from. Further, layers 316, 314, and 318 may be deposited and patterned.

In certain aspects, the damping holes may be partially etched prior to bonding. The damping channel of layer 304 can be a single channel or plurality of channels that enables layer 312 to be partially free. Layer 306 can be removed and bonded to layer 310. In some aspects, an additional adhesive layer can be placed on layer 310 to bond layer 310 with layer 302. The cantilever beams may be formed to enhance the actuation of the diaphragms in which either layer 306 or the additional adhesive layer is placed on top of layer 310. Layer 308 may be partially etched through the damping holes. As such, layer 312 may be freed from layer 308 and layer 304 to become an extendable diaphragm. Layer 314 can be deposited and patterned on layer 306 over the extendable diaphragm. Layer 316 can be deposited and partially patterned over layer 310 and 314. Further, layer 318 may be deposited and patterned over layers 306 and 316.

In some aspects, layer 306 is silicon dioxide and hydrofluoric (HF) acid vapor and liquid hydrofluoric (HF) acid may be used to remove silicon oxide from the silicon dioxide. The layer 306 of silicon dioxide can be used to create an airgap. As such, polysilicon may be deposited on the silicon dioxide and then silicon oxide is etched away using HF liquid, vapor, or some other chemical. When HF fluid acid used, the wafer may be rinsed in water to wash away the acid. In certain aspects, the water surface tension can cause the polysilicon layer to stick to one or more side walls of the silicon dioxide. In order to remove stiction after a removal of layer 306, super critical carbon dioxide may be used to release such stiction. For example, the super critical carbon dioxide may neutralize water molecules to further release the extendable diaphragm. After the removal of layer 306, self-assembled monolayers can be coated. The self-assembled monolayers can be put on the surface of layer 312 to prevent moisture, condensation, and the like. In certain aspects, the layers can be modified in which layer 314 is deposited via a shadow mask and extended outside the anchored diaphragm to be utilized as an electrical contact. As such, layer 318 can be deposited on top of layer 314 via a shadow mask. The shadow mask process can be utilized to avoid any wet or photo processes after the channels are etched and layer 306 is removed. Further, the shadow mask process may be utilized to reduce the total number of masking processes needed.

Figure 4:
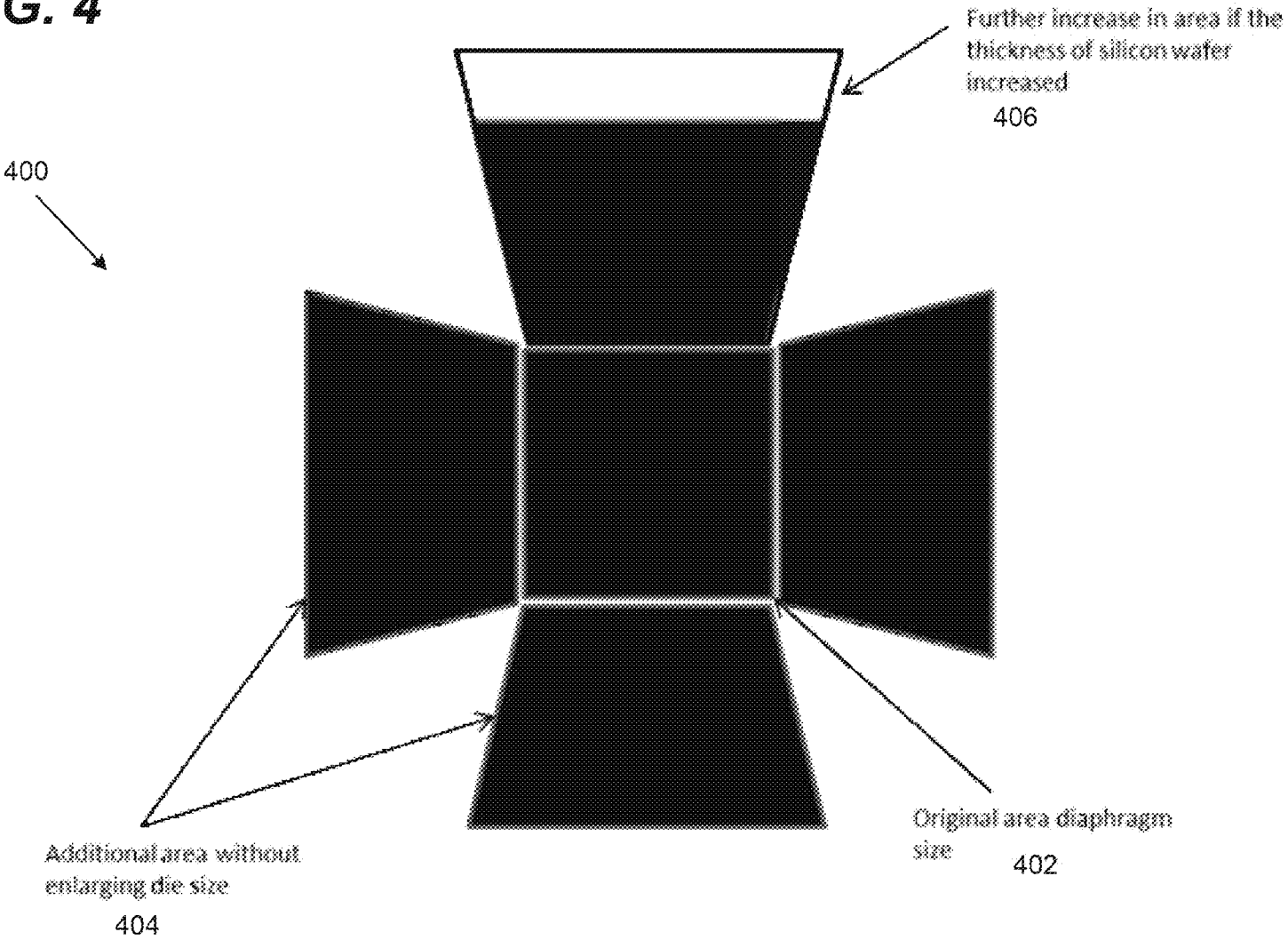
FIG. 4 is a surface area of an extendable diaphragm, according to certain exemplary aspects.

FIG. 4 is a surface area of an extendable diaphragm 400, according to certain exemplary aspects. The surface area of an extendable diaphragm 400 illustrates a large surface area for the formation of an extendable diaphragm. As such, the extendable diaphragm can include an initial size 402, additional area that does not enlarge a die size 404, and a further increase in surface area of the extendable diaphragm 406. Additionally, the large surface area proportionately enlarges the size of the die 404 to form a larger surface area for the acoustic apparatus to release sound waves. FIG. 4 illustrates a cone shaped surface area that enables the fabrication of an extendable diaphragm with a larger surface area. In certain aspects, the extendable diaphragm is fabricated utilizing a silicon substrate. As would be known by one of ordinary skill in the art, the extendable diaphragm is not limited to a silicon substrate. As such, the extendable diaphragm may be fabricated utilizing any other suitable substrates. The thickness of the substrate may range from a few to several hundred microns. The surface area can include a semicircle shape, a parabola shape, a step cavity, and the like, and therefore the shape of the surface area is not limiting upon the features described in the present disclosure.

Figure 5A:
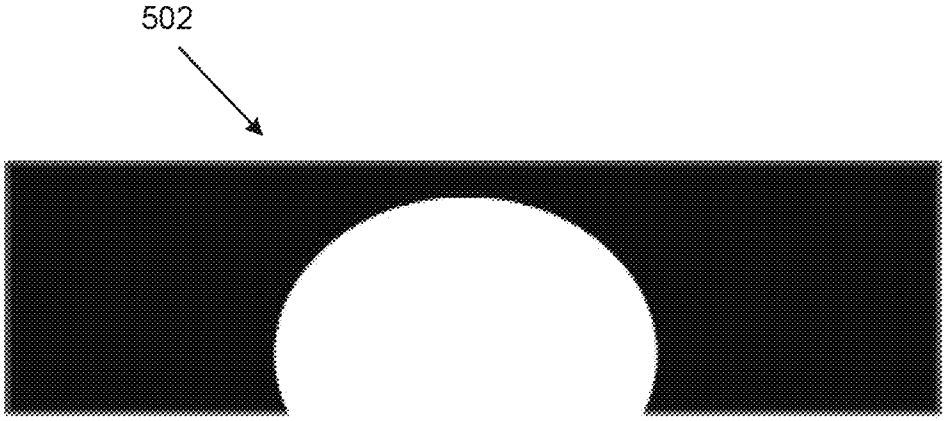
FIG. 5A is an enlarged extendable diaphragm, according to certain exemplary aspects.

FIG. 5A is an enlarged extendable diaphragm 502, according to certain exemplary aspects. FIG. 5A illustrates an exemplary enlarged extendable diaphragm 502 with a semicircle shape.

Figure 5B:
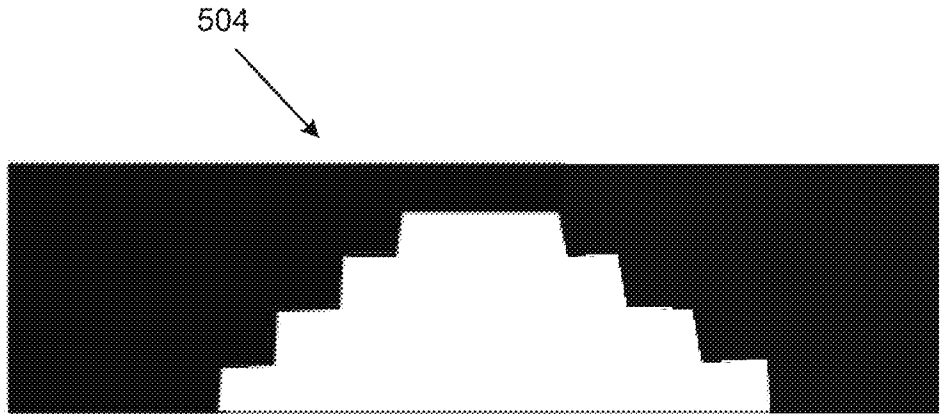
FIG. 5B is an enlarged extendable diaphragm, according to certain exemplary aspects.

FIG. 5B is an enlarged extendable diaphragm 504, according to certain exemplary aspects. FIG. 5B illustrates an exemplary enlarged extendable diaphragm 504 with a step cavity.

Figure 6:
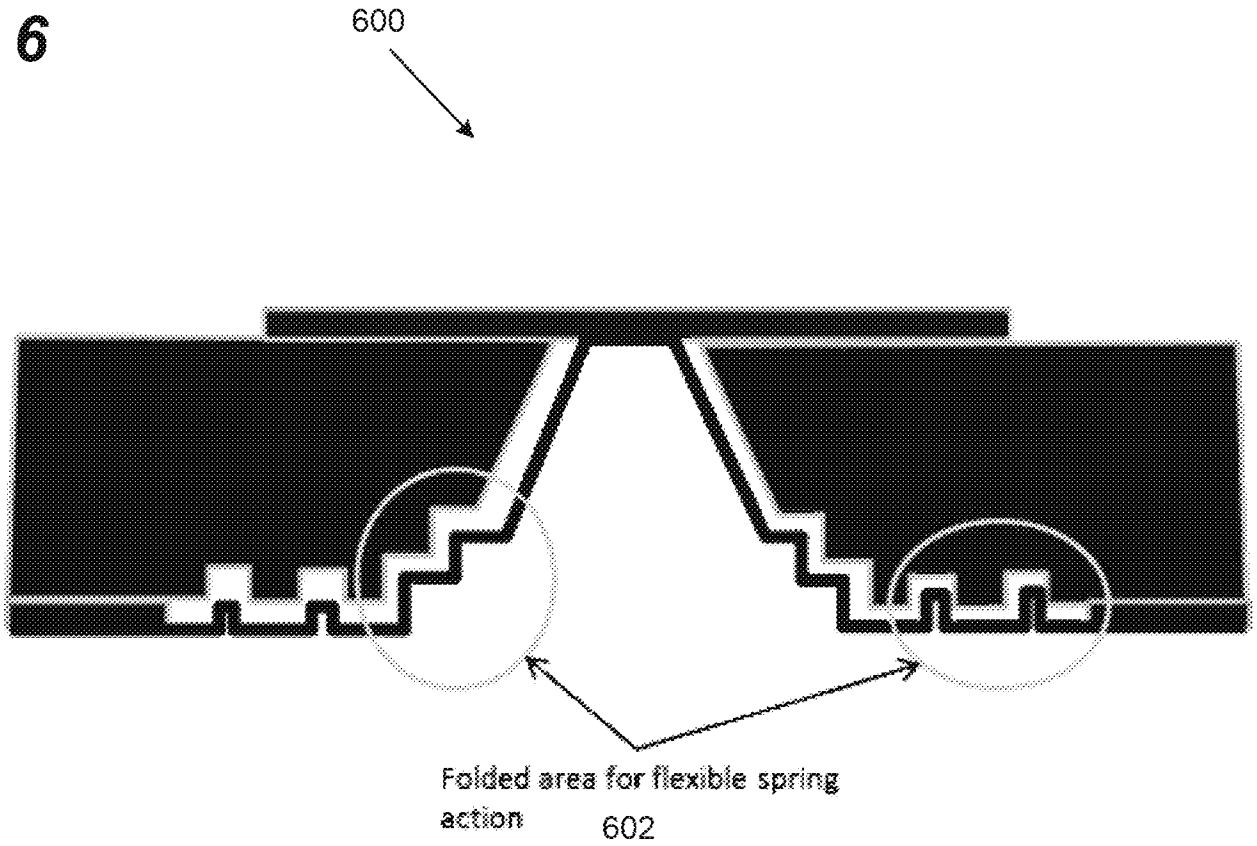
FIG. 6 is a folded portion of an acoustic apparatus, according to certain exemplary aspects.

FIG. 6 is a folded portion of an acoustic apparatus 600, according to certain exemplary aspects. The folded portion 602 is created at the edge of the extendable diaphragm for the flexibility of movement of the extendable diaphragm. The folded portion 602 can be utilized for spring action of the extendable diaphragm. The folded portion 602 can include one or more portions and can be utilized separately and/or combined for additional flexibility. As such, the increased flexibility of the extendable diaphragm allows the extendable diaphragm to move a greater distance without damaging the anchored diaphragm.

Figure 7:
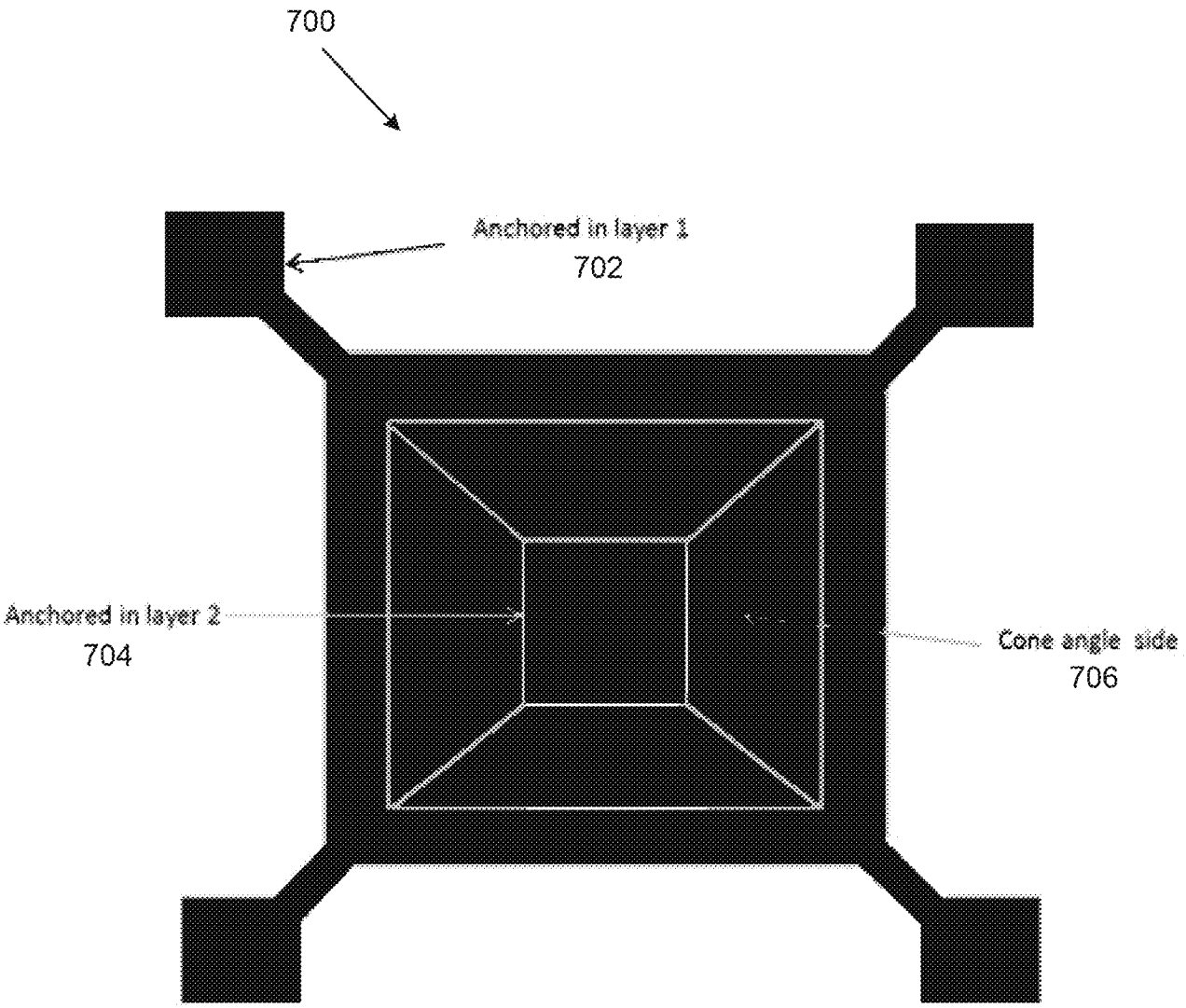
FIG. 7 is an extendable diaphragm anchored via a cantilever beam, according to certain exemplary aspects.

FIG. 7 is an extendable diaphragm anchored via a cantilever beam 700, according to certain exemplary aspects. FIG. 7 illustrates a top view of the extendable diaphragm. The extendable diaphragm can be anchored in a first layer (layer 1) 702 a second layer (layer 2) 704, connected via a cone angle side 706 of the extendable diaphragm, including a cantilever beam for additional flexibility.

Figure 8:
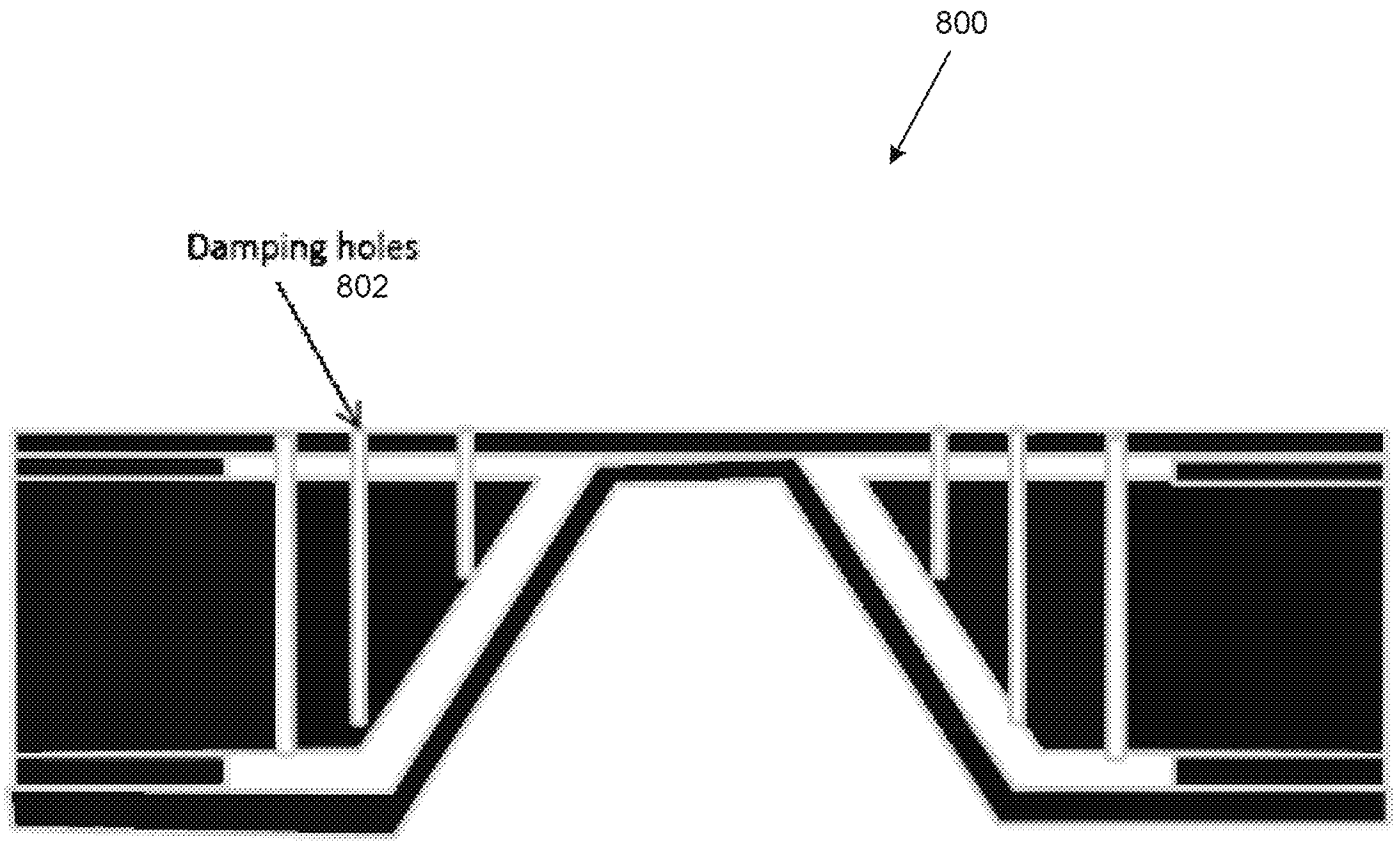
FIG. 8 is a cross section of an acoustic apparatus showing damping holes, according to certain exemplary aspects.

FIG. 8 is a cross section of an acoustic apparatus showing damping holes 800, according to certain exemplary aspects. As the anchored diaphragm is actuated to oscillate, the extendable diaphragm is configured to freely actuate. In this instance, damping holes 802 may be utilized to allow the extendable diaphragm to freely actuate in the vertical direction. The damping holes 802 may be etched down to the side walls of the cone angle and the folded portion of the extendable diaphragm. In certain aspects, the damping holes 802 may act as a channel to etch and remove parts of layers in the acoustic apparatus so that other layers may be freed up.

Figure 9A:
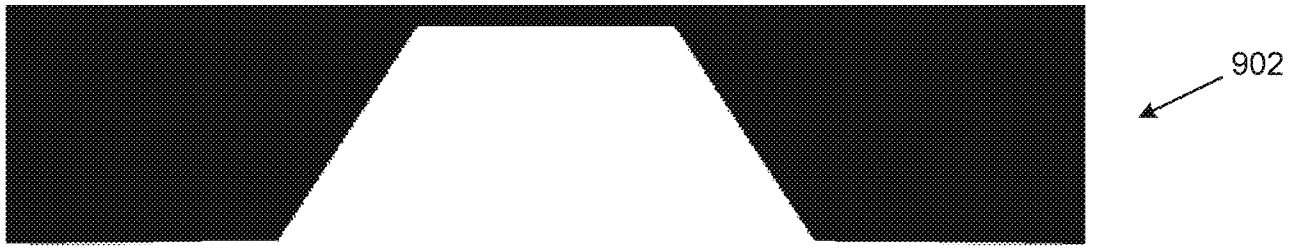
FIG. 9A is an anchored diaphragm, according to certain exemplary aspects.

FIG. 9A is an anchored diaphragm 902, according to certain exemplary aspects. FIG. 9A illustrates a formation of an anchored diaphragm via partial etching of a layer 902. As such, an anchored diaphragm or a thin area can be formed over the partially etched layer.

Figure 9B:
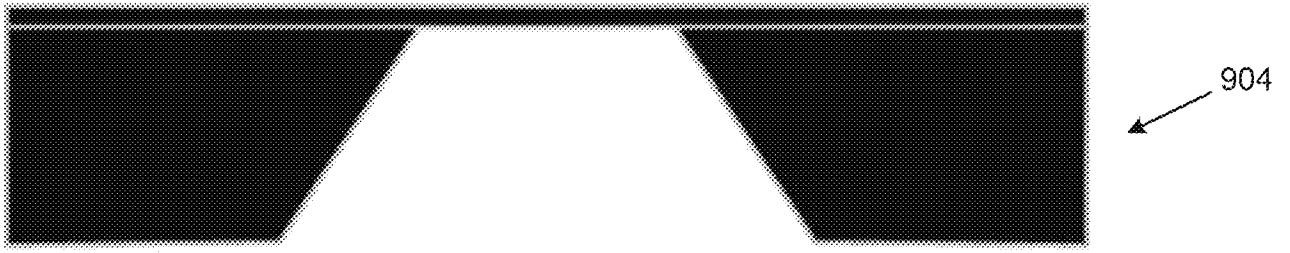
FIG. 9B is an anchored diaphragm formed by bonding, according to certain exemplary aspects.

FIG. 9B is an anchored diaphragm formed by bonding 904, according to certain exemplary aspects. FIG. 9B illustrates a formation of an anchored diaphragm via etching a cavity fully and using a layer to form an anchored diaphragm thereof 904. In certain aspects, the layer can be a single substrate that is ground down to a few microns. In other aspects, the layer can include multiple substrates such as a SOI (silicon on insulator) wafer in which the handle wafer is fully or partially removed down to the layer. The SOI wafer can include single crystal silicon, polysilicon, or any other thin film that is known.

Figure 9C:
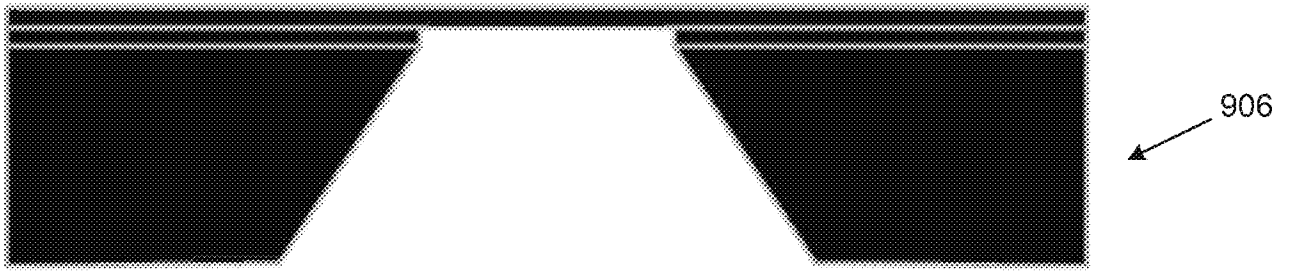
FIG. 9C is an anchored diaphragm formed by bonding, according to certain exemplary aspects.

FIG. 9C is an anchored diaphragm formed by bonding 906, according to certain exemplary aspects. FIG. 9C illustrates a formation of an anchored diaphragm via the lamination of a film over a cavity. The formation can include a P-N wafer that is electrochemically etched and a constraint wafer may be fully or partially removed dowry to a layer. In another example, the formation can include a P++ doped wafer and a constraint wafer may be fully or partially removed down to a layer.

Figure 9D:
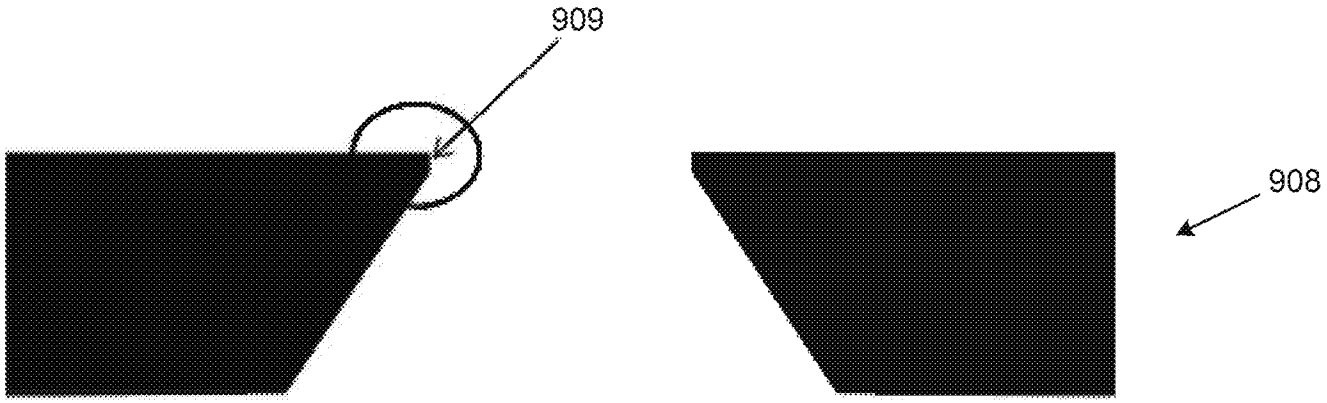
FIG. 9D is a vertical edge formation, according to certain exemplary aspects.

FIG. 9D is a vertical edge formation 908, according to certain exemplary aspects. FIG. 9D illustrates a formation of an anchored diaphragm via the formation of a vertical edge 909. The formation of the vertical edge 909 can include full etching so that the damping holes are accurately placed within the acoustic apparatus.

Figure 10A:
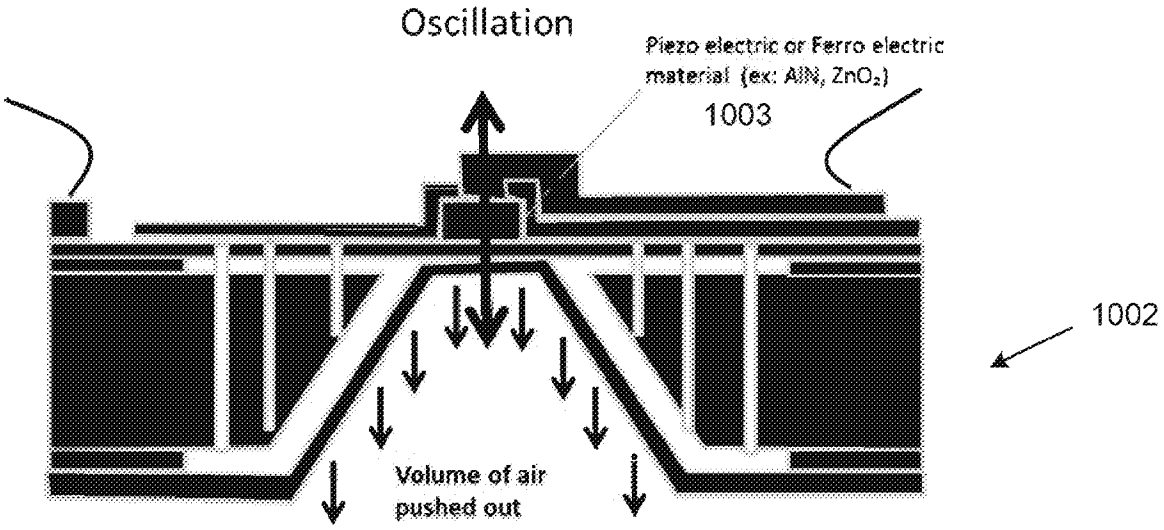
FIG. 10A is an acoustic apparatus utilizing Piezo electric actuation, according to certain exemplary aspects.

FIG. 10A is an acoustic apparatus utilizing Piezo electric actuation 1002, according to certain exemplary aspects. The Piezo electric actuation is performed with transduction material. 1003. In certain aspects, the transduction material can include Piezo electric material, Ferro electric material, and the like. The Piezo electric material or Ferro electric material can be utilized to convert electrical energy into mechanical energy. A number of transduction principles can be used individually or in combination to convert the electrical energy into mechanical energy, including piezoelectric, piezo resistive, electro statistic, magnetic, thermal, and the like. The transduction is utilized to actuate the anchored diaphragm, to ultimately actuate the extendable diaphragm. The transduction material 1003 can be deposited on a layer over the anchored diaphragm. In certain aspects, the layer can be a separate layer that is utilized to form the anchored diaphragm.

Figure 10B:
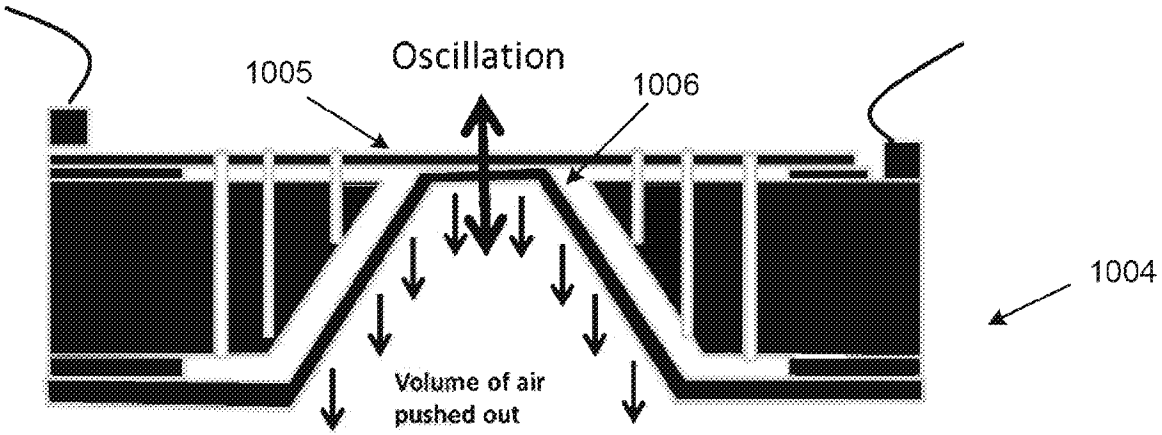
FIG. 10B is an acoustic apparatus utilizing electro static actuation, according to certain exemplary aspects.

FIG. 10B is an acoustic apparatus utilizing electro static actuation 1004, according to certain exemplary aspects. The electrostatic actuation can be performed between a first layer 1005 and a second layer 1006. The electrostatic actuation can include thermal materials, metallic materials, and the like, that are formed with the second layer 1006. In some aspects, the electrostatic actuation includes magnetic material that is formed between the first layer 1005 and the second layer 1006.

FIGS. 11-23 illustrate a fabrication method for making an acoustic apparatus, according to certain exemplary aspects. However, other fabrication methods are possible without departing from the scope of the advances described herein.

Figure 11:
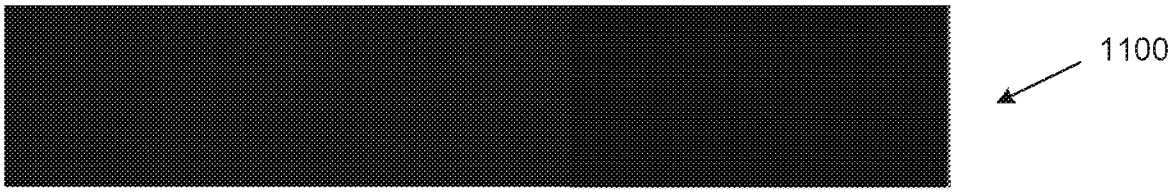
FIG. 11 illustrates a layer, according to certain exemplary aspects.

FIG. 11 illustrates a layer 1100, according to certain exemplary aspects. The layer can be provided as a first step in the fabrication method of making an acoustic apparatus.

Figure 12:
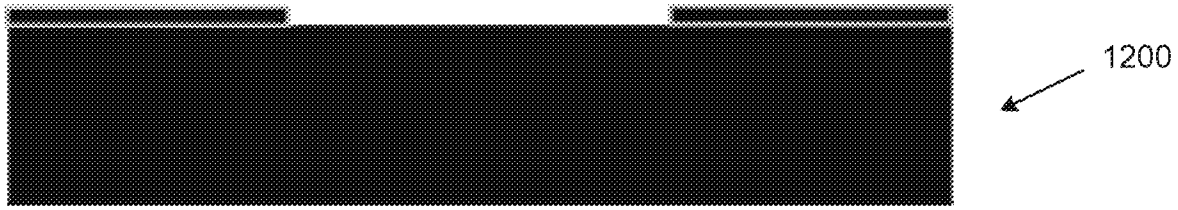
FIG. 12 illustrates a pattern formed on a layer, according to certain exemplary aspects.

FIG. 12 illustrates a pattern formed on a layer 1200, according to certain exemplary aspects. In certain aspects, the pattern can be formed on the layer to etch a folded portion of an extendable diaphragm. The pattern formation on the layer can be utilized as the second step in the fabrication method.

Figure 13:
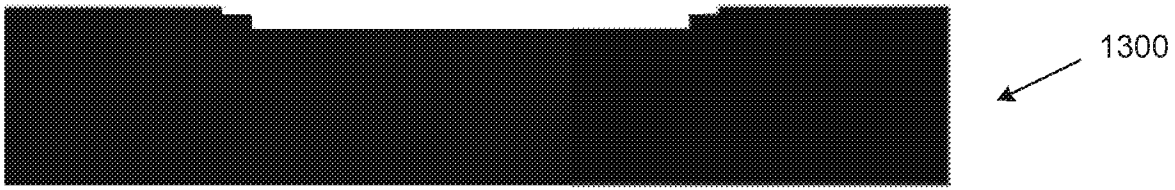
FIG. 13 illustrates a folded portion of the acoustic apparatus, according to certain exemplary aspects.

FIG. 13 illustrates a folded portion of the acoustic apparatus 1300, according to certain exemplary aspects. The folded portion can be etched into the layer. The etching of the folded portion can be the third step of the fabrication method.

Figure 14:
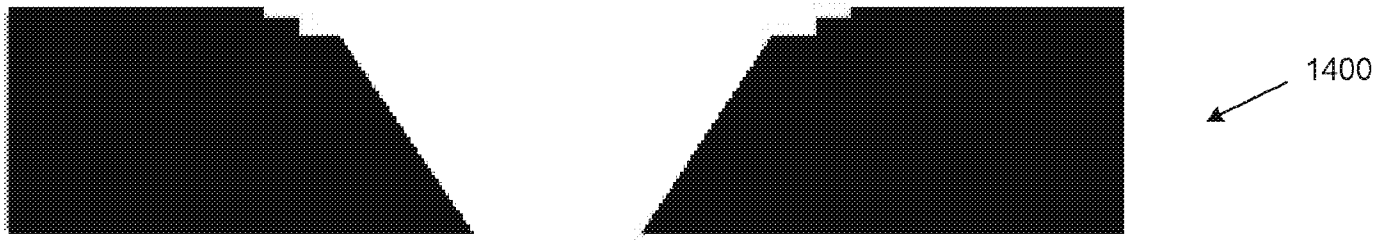
FIG. 14 illustrates a cavity formed in a layer of the acoustic apparatus, according to certain exemplary aspects.

FIG. 14 illustrates a cavity formed in a layer of the acoustic apparatus 1400, according to certain exemplary aspects. The cavity can be formed in the layer. In certain aspects, the cavity can be formed using an orientation of a silicon wafer that is etched with potassium hydroxide, or other similar chemical, to create a cone shaped cavity. The cone shaped cavity can include an angle of 54.7 degrees. The cavity formation can include the fourth step of the fabrication method.

Figure 15:
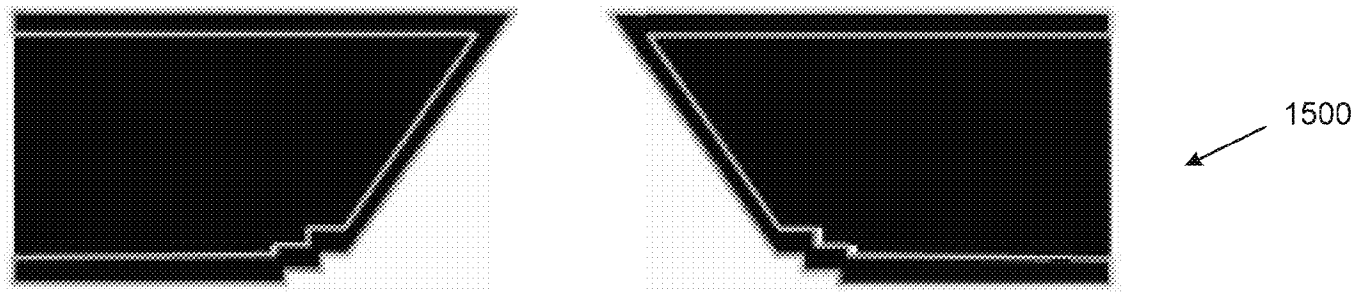
FIG. 15 illustrates a sacrificial layer deposited on a layer of the acoustic apparatus, according to certain exemplary aspects.

FIG. 15 illustrates a sacrificial layer deposited on a removed layer of the acoustic apparatus 1500, according to certain exemplary aspects. In some aspects, the sacrificial layer can be grown over the removed layer. The sacrificial layer can be deposited/grown as the fifth step in the fabrication method.

Figure 16:
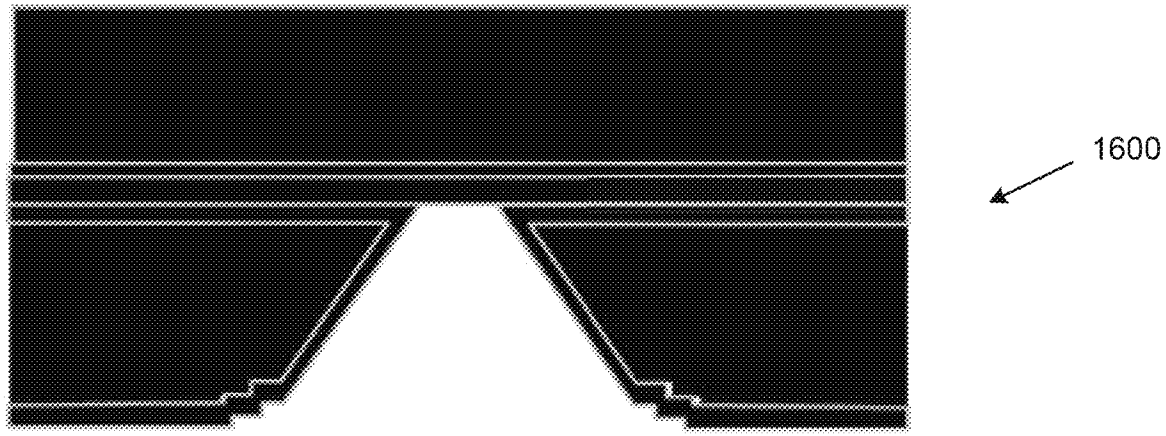
FIG. 16 illustrates a wafer bonded to a layer of the acoustic apparatus, according to certain exemplary aspects.

FIG. 16 illustrates a wafer bonded to a layer of the acoustic apparatus 1600, according to certain exemplary aspects. In certain aspects, the wafer can include a SOI wafer. The bonding of the wafer can be the sixth step of the fabrication method.

Figure 17:
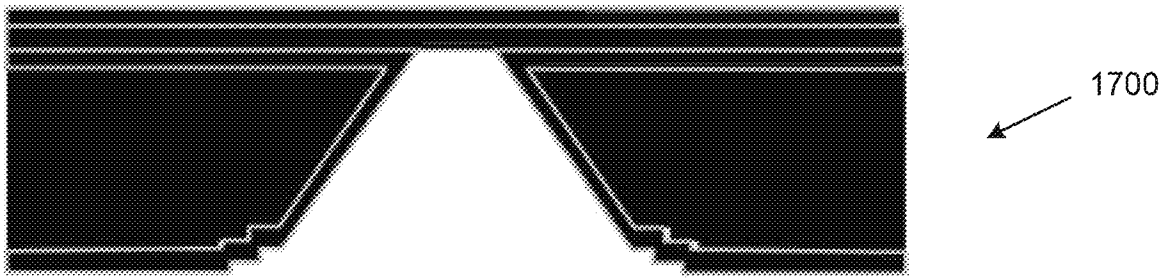
FIG. 17 illustrates a constraint wafer removed from a wafer of the acoustic apparatus, according to certain exemplary aspects.

FIG. 17 illustrates a constraint wafer removed from a wafer of the acoustic apparatus 1700, according to certain exemplary aspects. The constraint wafer can be removed from an SOI wafer to form a layer. The removal of the constraint wafer can be the seventh step of the fabrication method.

Figure 18:
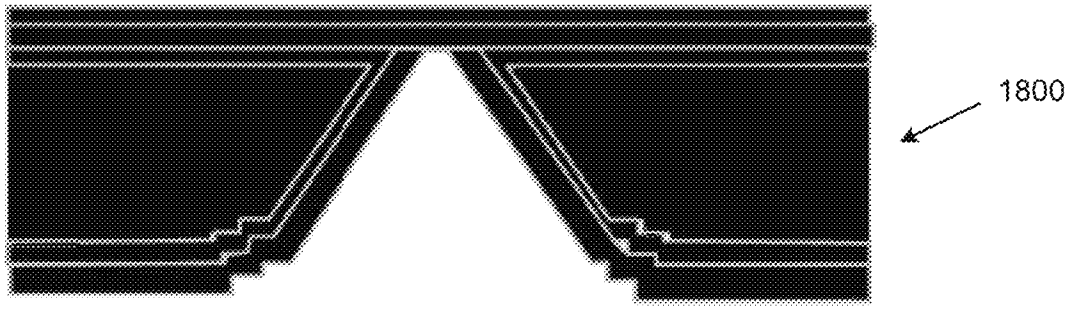
FIG. 18 illustrates a layer deposited on another aye of the acoustic apparatus, according to certain exemplary aspects.

FIG. 18 illustrates a layer deposited on another layer of the acoustic apparatus 1800, according to certain exemplary aspects. In certain aspects, the layer can be grown on another layer rather than deposited. The layer can be deposited on another layer as the eighth step in the fabrication method.

Figure 19:
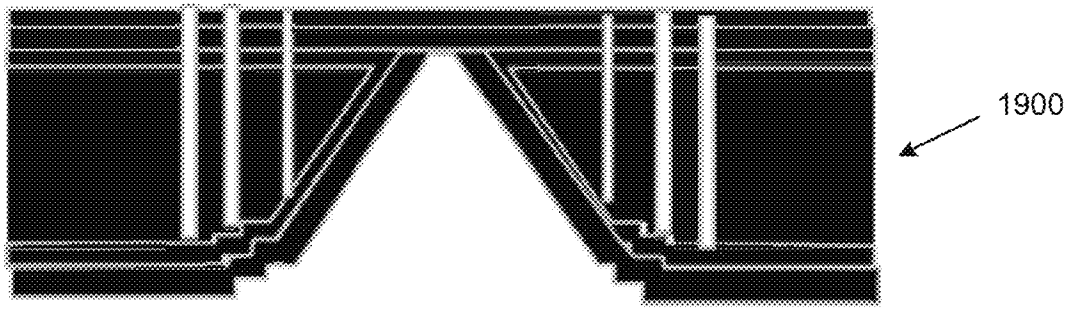
FIG. 19 illustrates etched damping holes of the acoustic apparatus, according to certain exemplary aspects.

FIG. 19 illustrates etched damping holes of the acoustic apparatus 1900, according to certain exemplary aspects. The damping holes can be etched to reach bottom walls, side walls, or both of a layer. In certain aspects, the damping holes can be etched to reach angled side walls of a layer. Further, a sacrificial layer can be released from the angled side walls in response to the etching of the damping holes. The etching of damping holes can be utilized as the ninth step in the fabrication method.

Figure 20:
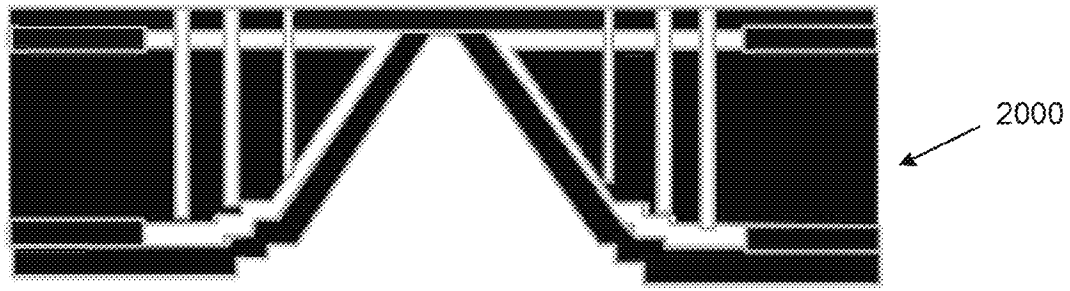
FIG. 20 illustrates a partially removed layer during manufacture of the acoustic apparatus, according to certain exemplary aspects.

FIG. 20 illustrates a partially removed layer of the acoustic apparatus 2000, according to certain exemplary aspects. The partially removed layer may be removed to free up another layer. In freeing up another layer, the extendable diaphragm may be able to actuate a greater distance in a vertical direction. In certain aspects, photoresist can be utilized to fill damping holes and then removed via a masking process.

Figure 21:
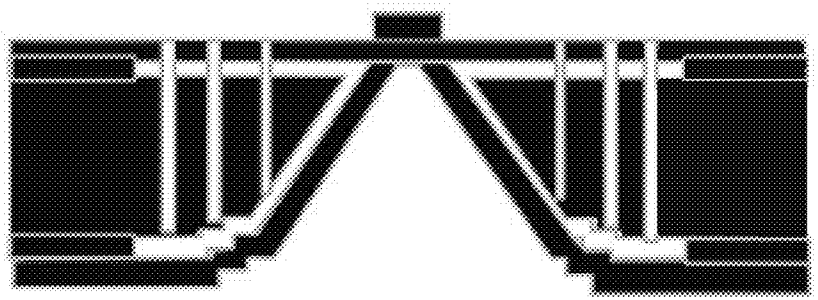
FIG. 21 illustrates Piezo electric material deposited and pattern over a layer of the acoustic apparatus, according to certain exemplary aspects.

FIG. 21 illustrates Piezo electric material deposited and pattern over a layer of the acoustic apparatus 2100, according to certain exemplary aspects. The Piezo electric material may be deposited and patterned over a layer that includes an anchored diaphragm.

Figure 22:
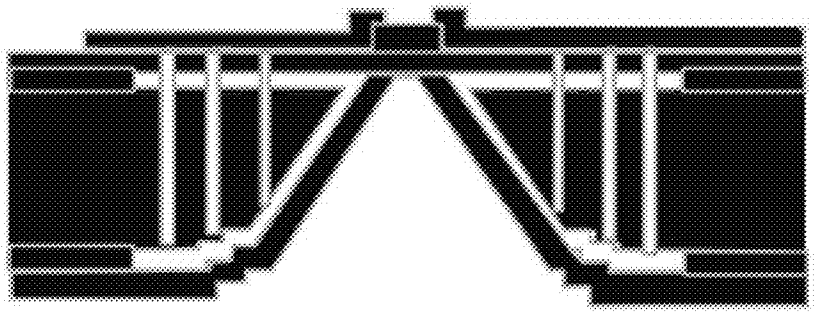
FIG. 22 illustrates dielectric material deposited and patterned over a layer of the acoustic apparatus, according to certain exemplary aspects.

FIG. 22 illustrates dielectric material deposited and patterned over a layer of the acoustic apparatus 2200, according to certain exemplary aspects.

Figure 23:
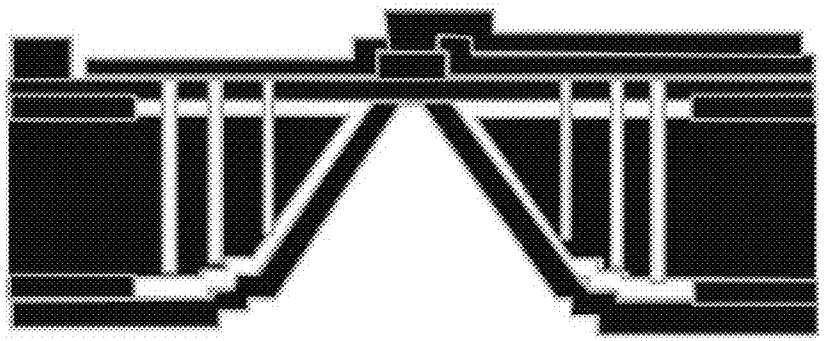
FIG. 23 illustrates metal deposited and patterned for an electrical contact of the acoustic apparatus, according to certain exemplary aspects.

FIG. 23 illustrates metal deposited and patterned for electrical contact of the acoustic apparatus 2300, according to certain exemplary aspects.

Figure 24:
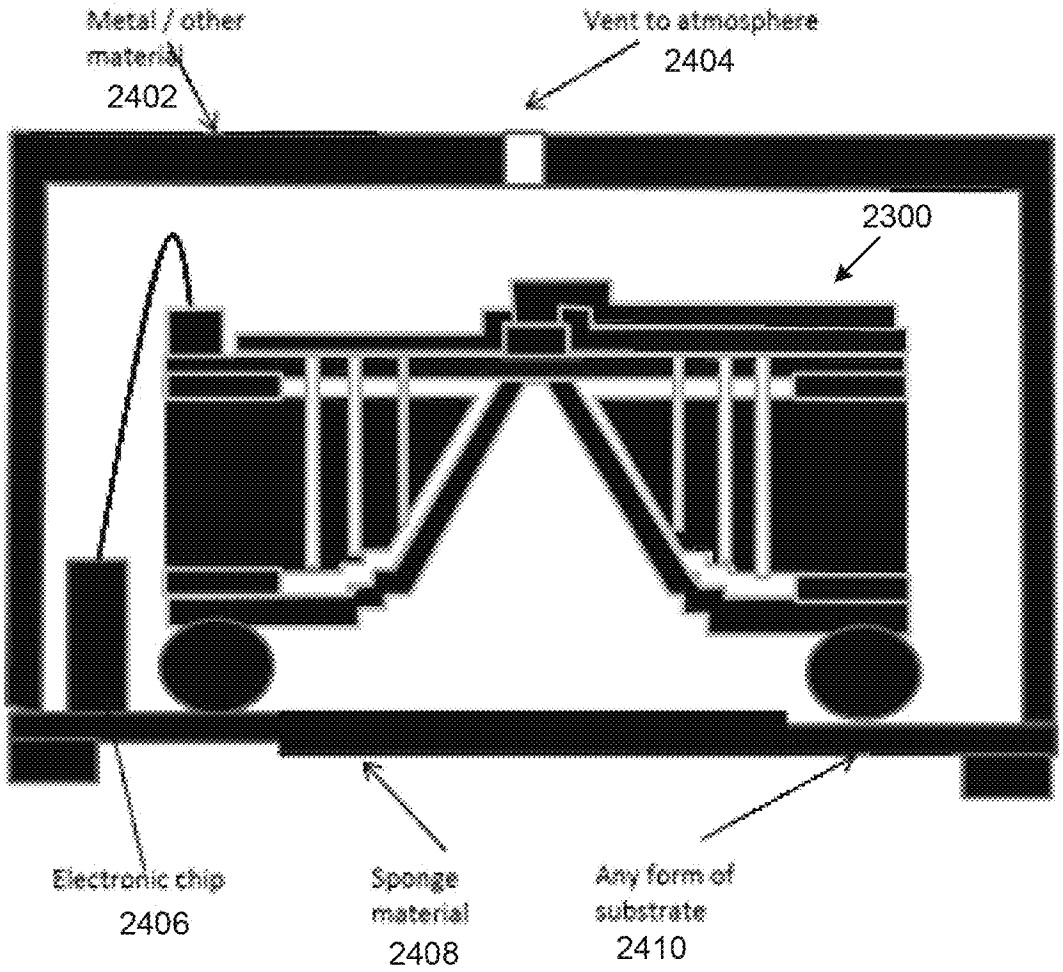
FIG. 24 is a packaging of an acoustic apparatus, according to certain exemplary aspects.

FIG. 24 is a packaging of an acoustic apparatus 2400, according to certain exemplary aspects. The packaging 2400 can include an acoustic apparatus 2300, a casing composed of metal or other material 2402, a vent to the atmosphere for aeration 2404, an electronic chip 2406 in communication with the acoustic apparatus 2300, sponge material 2408, and a substrate 2410. The acoustic apparatus 2300 can be packaged in a surface mount package for various applications. The acoustic apparatus 2300 can be provided in multiple array patterns for a receiver/speaker application. The multiple array patterns can be fabricated at a wafer level, assembled in packaging, and the like. The packing substrate 2410 can include any suitable material, or it can be placed on a PCB. In certain aspects, the acoustic apparatus 2300 can be a flip chip that is assembled directly on a substrate.

The acoustic apparatus can be utilized as a receiver and speaker. The acoustic apparatus includes transduction mechanisms to produce a sensitive and dynamic frequency response to inputs such as electrical current and electrical voltage. The acoustic apparatus provides an increased cavity surface area that does not result in a proportionately enlarged die size. The acoustic apparatus also includes a folded portion that permits an extendable diaphragm to expand and release air pressure in the form of sounds waves, as an anchored diaphragm is actuated to oscillate. Further, the acoustic apparatus includes damping holes that can be utilized to act as channels for releasing etch. As such, the acoustic apparatus is a device functions as a receiver and speaker that responds to electrical signal by dynamically releasing air that comes into contact with an anchored diaphragm of the acoustic apparatus.

There is currently no viable design and fabrication process that meets the requisite performance standards for a silicon receiver and speaker (acoustic apparatus), or the industry standard cost requirement. The acoustic apparatus' principle is opposite to that of the microphone. The microphone receives sound pressure waves and converts it into an electrical signal, whereas the receiver and speaker push out the sound pressure waves that are converted from the electrical signal. Therefore, a larger diaphragm area is required, unlike the silicon microphone. The larger diaphragm area means that the size of the device has to be large. Devices with increased die size usually have a negative impact: the number of devices per wafer is reduced and subsequently becomes costly and thus unable to compete with conventional technology. Hence, there exists a need to invent a device and technique that substantially reduces the size of the device but yet maintains a relatively large diaphragm area.

The design and method of fabrication of the acoustic apparatus provides an elegant solution that performs the function of a silicon receiver and speaker while also providing an efficient manufacturing method to meet the industry's economic needs.

A number of implementations have been described. Nevertheless, it will be understood that various modifications may be made without departing from the spirit and scope of this disclosure. For example, preferable results may be achieved if the steps of the disclosed techniques were performed in a different sequence, if components in the disclosed systems were combined in a different manner, or if the components were replaced or supplemented by other components. Additionally, an implementation may be performed on modules or hardware not identical to those described. Accordingly, other implementations are within the scope that may be claimed.

The invention claimed is:

1. An acoustic apparatus, comprising:

an anchored diaphragm that is actuated by mechanical energy;

a transduction material that is disposed in the anchored diaphragm and that generates the mechanical energy that actuates the anchored diaphragm;

an extendable diaphragm that is actuated when the anchored diaphragm is actuated; and a plurality of damping holes that are disposed about the extendable diaphragm and that allow the extendable diaphragm to actuate in a vertical direction, wherein the extendable diaphragm includes a plurality of folded portions that allow the extendable diaphragm to actuate without damaging the anchored diaphragm.

2. The acoustic apparatus of claim 1, wherein the anchored diaphragm is actuated when at least one of an alternating current or an alternating current pass through the transduction material.

3. The acoustic apparatus of claim 1, wherein the transduction material includes Piezoelectric material and the anchored diaphragm includes a poly silicon film.

4. The acoustic apparatus of claim 1, wherein the extendable diaphragm is fixed to a cantilever beam.

5. The acoustic apparatus of claim 1, wherein the plurality of folded portions are at least one of separated or combined to extend a flexibility of the extendable diaphragm.

6. The acoustic apparatus of claim 1, wherein the extendable diaphragm is actuated to release air pressure through an oscillation of the anchored diaphragm.

7. The acoustic apparatus of claim 6, wherein the released air pressure includes sound waves.

8. The acoustic apparatus of claim 1, wherein a surface area of the extendable diaphragm is enlarged via a first substrate.

9. The acoustic apparatus of claim 8, wherein the first substrate includes at least one of a semicircle shape, a parabola shape, and a step cavity.

10. The acoustic apparatus of claim 8, wherein the first substrate includes a thickness of 1-500 microns.

11. The acoustic apparatus of claim 1, wherein the anchored diaphragm includes one or more second substrates.

* * * * *